United States Patent [19]

Brändstrom

[11] 4,012,938

[45] Mar. 22, 1977

[54] DEVICE FOR INSERTING OR REMOVING A HOT BLANK IN A DROP HAMMER

[75] Inventor: Karl Ivar Brändstrom, Karlskoga, Sweden

[73] Assignee: AB Bofors, Bofors, Sweden

[22] Filed: May 21, 1975

[21] Appl. No.: 579,634

[30] Foreign Application Priority Data

June 7, 1974 Sweden ..... 7407506

[52] U.S. Cl. ..... 72/422; 294/88; 294/106; 214/1 BC; 72/426; 72/405

[51] Int. Cl.[2] ..... B21D 43/10; B21D 45/06

[58] Field of Search ..... 72/420, 422, 426, 427, 72/405; 164/131, 344, 404–408; 214/1 BC, 1 BH; 294/88, 106, 115

[56] References Cited

UNITED STATES PATENTS

| | | | |
|---|---|---|---|
| 2,677,342 | 5/1954 | Miller | 294/88 X |
| 2,811,266 | 10/1957 | Udal | 72/426 X |
| 2,940,791 | 6/1960 | Lorenson et al. | 294/106 X |
| 3,010,587 | 11/1961 | Hollinger | 72/405 X |
| 3,401,739 | 9/1968 | Opletal | 164/408 |
| 3,620,095 | 11/1971 | Dane | 294/115 X |
| 3,651,957 | 3/1972 | Ball | 214/1 BC |
| 3,718,216 | 2/1973 | Wilson | 214/1 BC |
| 3,731,822 | 5/1973 | Friesen et al. | 294/106 X |
| 3,741,517 | 6/1973 | Pogonowski | 294/88 X |
| 3,760,956 | 9/1973 | Burch | 214/1 BC |
| 3,867,849 | 2/1975 | Onoda | 214/1 BC |

FOREIGN PATENTS OR APPLICATIONS

| | | | |
|---|---|---|---|
| 1,137,175 | 9/1962 | Germany | 164/407 |
| 564,208 | 9/1944 | United Kingdom | 164/407 |

*Primary Examiner*—C.W. Lanham
*Assistant Examiner*—D. M. Gurley
*Attorney, Agent, or Firm*—Pollock, VandeSande & Priddy

[57] ABSTRACT

A device for manipulating a hot blank relative to a forging tool in a drop hammer comprises a plurality of gripping jaws carried by a unit connected to a rotatable tongs arm, said jaws being pivotably mounted for selective movement through a limited arc toward and away from one another, and each of said jaws including a gripping claw adapted to be longitudinally displaced relative to its associated jaw. Movement of the tongs arm and associated movement of the gripping jaws and their respective gripping claws is employed to selectively position the several claws within cup-shaped recesses formed in the forging tool at positions underlying the flash of a hot blank in the tool. The unit further includes counter-holders which are positioned to overlie the forging tool in spaced relation to said flash whereby the simultaneous coaction between the gripping claws and blank and between the counter-holders and forging tool operate to break a forged blank loose from said tool.

9 Claims, 20 Drawing Figures

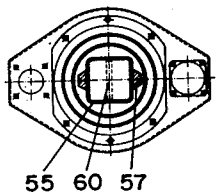
Fig. 8d
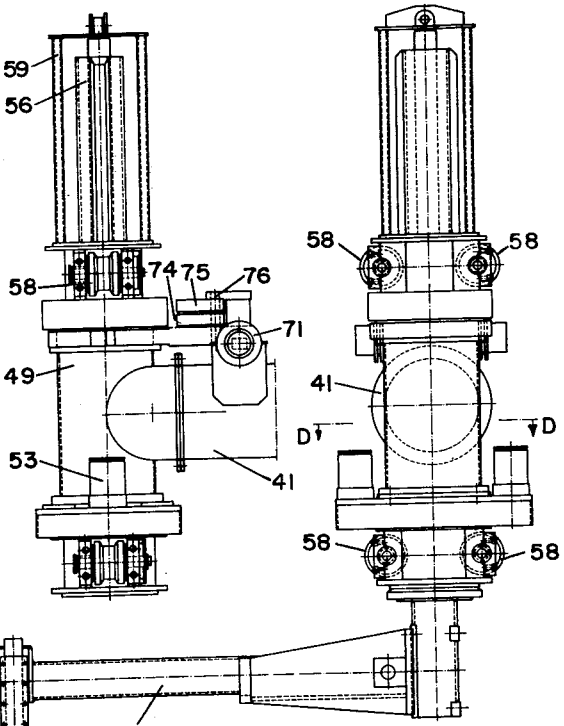
Fig. 8a
Fig. 8c
Fig. 8b

DEVICE FOR INSERTING OR REMOVING A HOT BLANK IN A DROP HAMMER

The present invention relates to a device for inserting or removing a hot blank in a drop hammer by means of gripping jaws arranged on a rotatable tongs arm.

One main purpose of the invention is to automatize the handling of the blank when drop forging, in order to eliminate to a great extent the heavy and hot manual work involved in such manufacture.

When it is desired to manually break loose a forging from the lower part of a forging die, an iron bar or the like is used in order to attain a shifting of the forging and so that it can be grasped with the manually operated gripping tongs at the edge of the flash on the forging. In an automatized process, however, it is necessary that such breaking loose with a bar and shifting of the position be eliminated.

Another purpose of the present invention is therefore to provide for suitable gripping and fixing of the blank for the automatized process. For further developments of the concept of the invention, robot equipment is utilized, which is controlled so that it can automatically transfer a heated blank from a conveyer belt and insert it direct into the die, whereupon further robot equipment can be utilized to remove the completed forging from the forging die and transfer it to a so-called trimming press. In an alternative embodiment, the same robot equipment is used for both the transferring from the conveyor belt to the drop hammer and for the transferring from the drop hammer to the trimming press.

The feature that can primarily be considered to be characteristic of the new device is that, at the forging tool, the gripping jaws are adapted to be automatically controlled by means of robot equipment comprising a tongs arm, the gripping jaws being arranged to coact with the blank via special recesses made for the jaws in the lower die. The recesses in the example of the embodiment are cup-formed, and arranged in such a way that, when the forging is being removed, the gripping jaws can coact with the flash arising when the blank is forged.

Figure 5A:
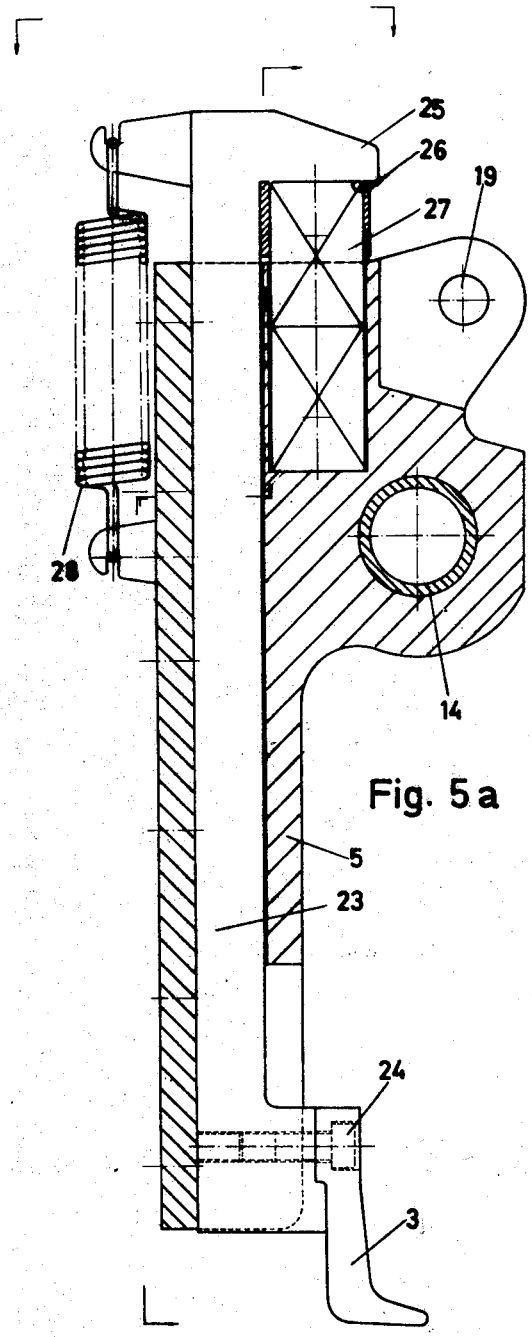
Figure 5B:
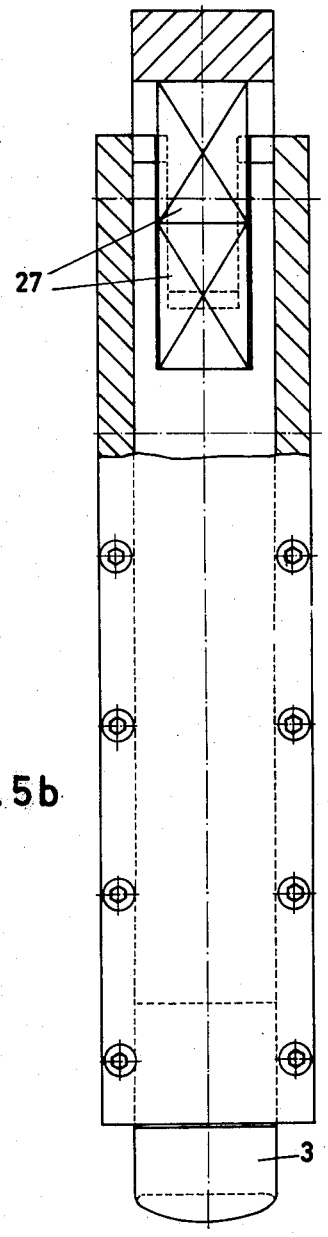
Figure 5C:
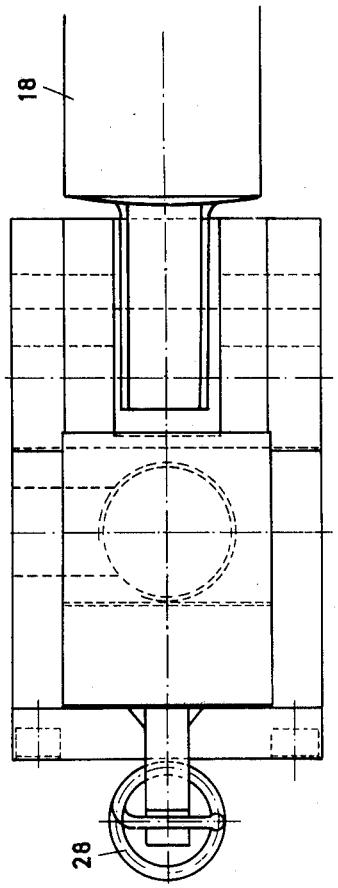
Figure 10:
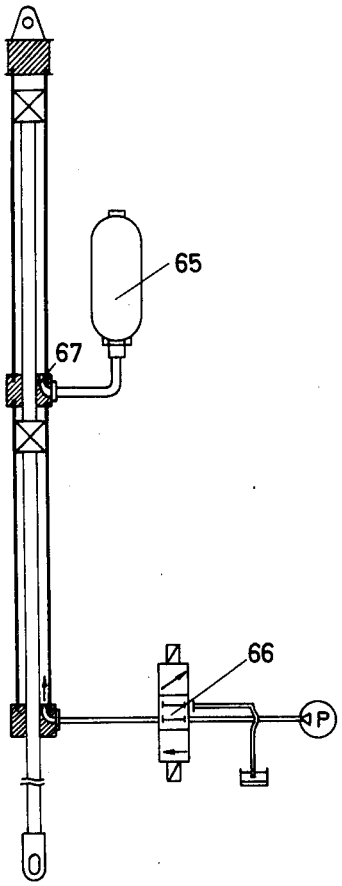
Figure 6A:
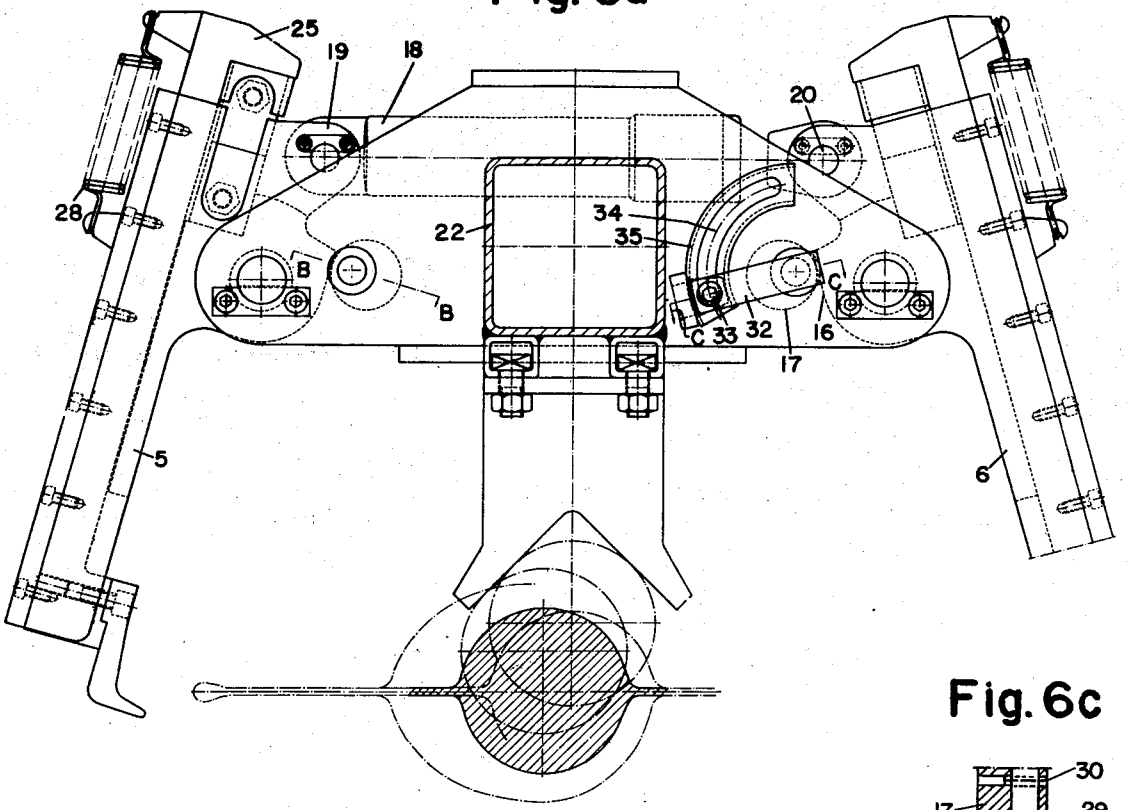
Figure 6C:
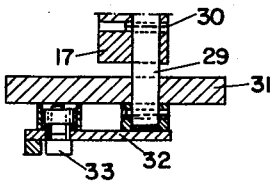
Figure 6B:
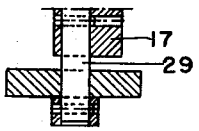
Figure 7A:
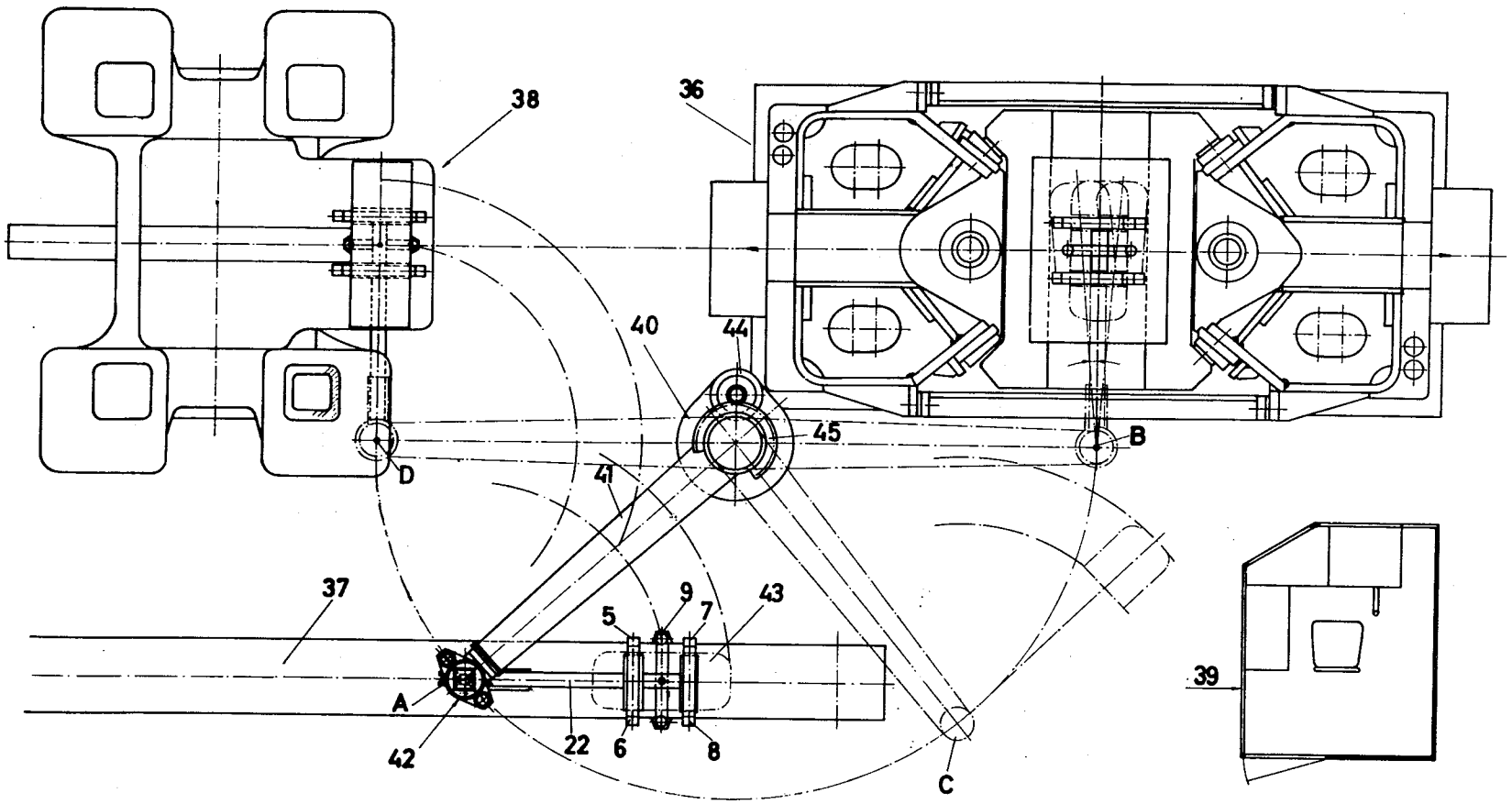
Figure 7B:
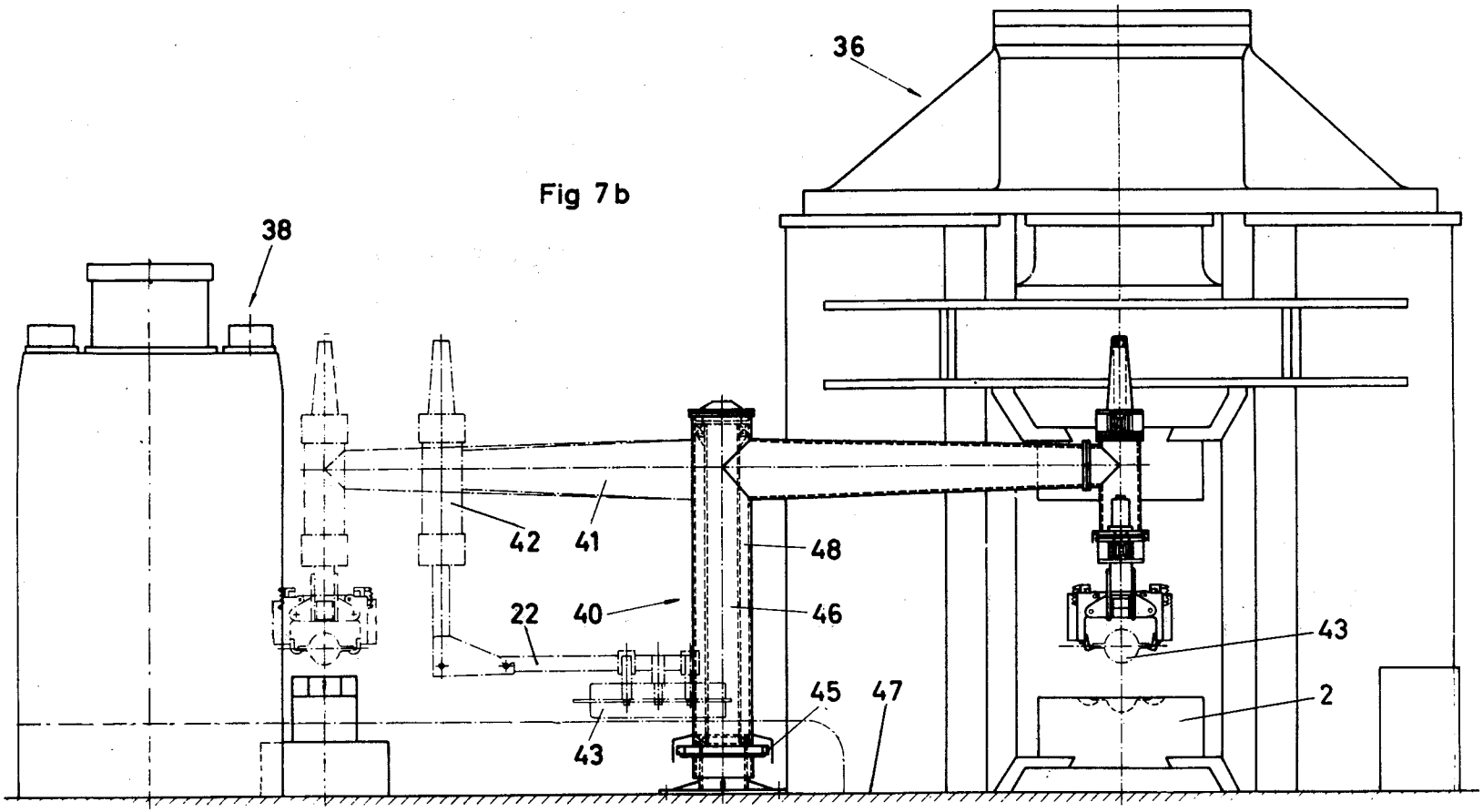

An embodiment proposed at present of a device which has the characteristics significant for the invention will be described in the following, with reference to the accompanying drawings, in which FIG. 1 in a horizontal view shows the lower part of a die, FIG. 2 in a first vertical view and in cross-section shows parts of the lower part according to FIG. 1, FIG. 3 in a second vertical view taken on line A-A of FIG. 2 and partly in cross section shows the parts illustrated in FIG. 2, FIGS. 4*a*–4*b* in different vertical views show a unit supporting the gripping jaws of the device, FIGS. 5*a*–5*c* in different views and partly in cross-section show a gripping jaw in detail, FIG. 6*a* in a vertical view and partly in cross-section shows the fastening of the gripping jaws in the unit according to FIGS. 4*a*–4*b*, FIGS. 6*b*–6*c* in horizontal views and in cross-sections show the parts comprised in the unit according to FIG. 6*a*, FIGS. 6*b* and 6*c* comprising sections taken on lines B—B and C—C of FIG. 6*a* respectively, FIGS. 7*a*–7*b* in horizontal and vertical views show a complete set of robot equipment, FIGS. 8*a*–8*d* show different views of an assembly to which the unit according to FIGS. 4*a*–4*b* and 6*a* supporting the tongs arm is fastened, FIG. 8*d* comprising a section taken on line D—D of FIG. 8*a*, FIG. 9 in a horizontal view and partly in cross-section shows an example of stopping members for a column comprised in the robot equipment, FIG. 10 shows a skeleton diagram of a hydraulic cylinder comprised in the assembly according to FIGS. 8*a*–8*c*, and FIG. 11 in a horizontal view shows further examples of stopping members.

In the figures, parts corresponding to each other have been given the same reference designation.

Figure 1:
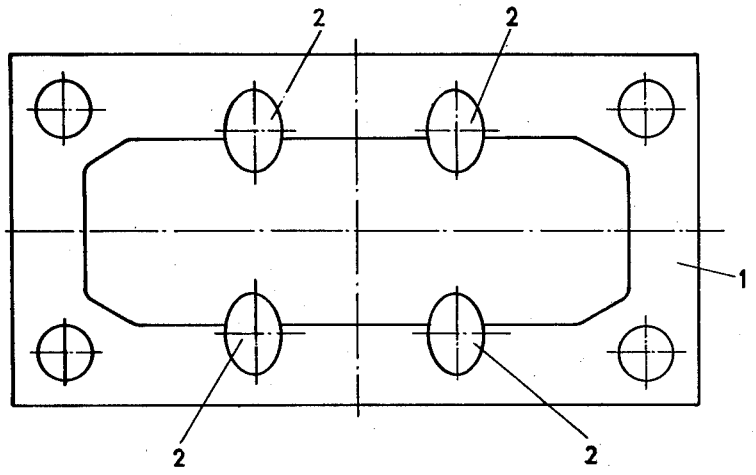

In FIG. 1, the lower part of a forging die is designated 1, and the expression "lower part" includes the actual engraved forging die. In the example of the embodiment, the lower part is made with four oval recesses 2 in its horizontal section, which are particularly intended to receive gripping jaws which are to grasp a hot blank inserted in the die.

Figure 2:
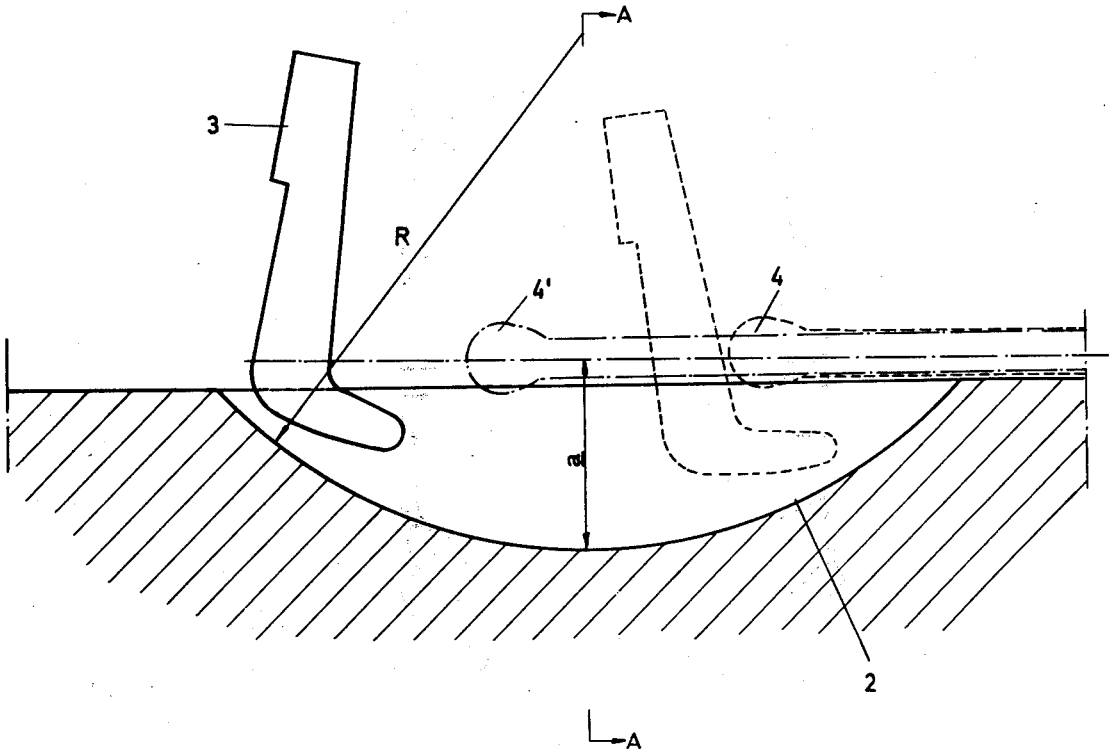
Figure 3:
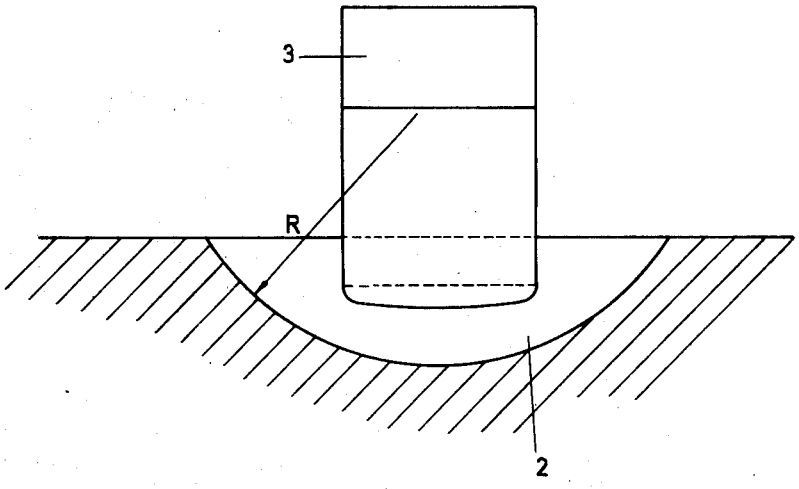

FIGS. 2 and 3 show the cup-formed recesses 2 in detail, and a gripping claw 3 is also shown which is to coact with the flash 4 obtained on a forging and which, depending on tolerances, can extend to different lengths from the forging. In the present case, the reference designation 4 indicates the minimum extent of the flash, while 4' indicates the maximum extent. The gripping claw 3 is selectively displaceable and is shown in broken lines in its position coacting with the edges of the flash, and is shown in solid lines in a position where it is clear of the edge of the flash. The free end part of the gripping claw 3 is made with a relief, which prevents the forging from becoming jammed.

Tests have shown that a typical recess 2 can be made with a radius R in one direction of approx. 125 mm, while the radius R' in the other direction has been chosen at approx. 85 mm.

The distance *a* (FIG. 2) between the deepest part of the recess 2 and the center line of the edge of the flash will thereby be approx. 45 mm.

Figure 4B:
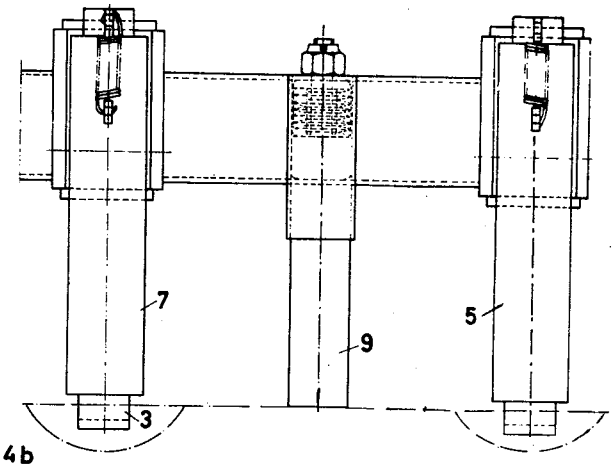
Figure 4A:
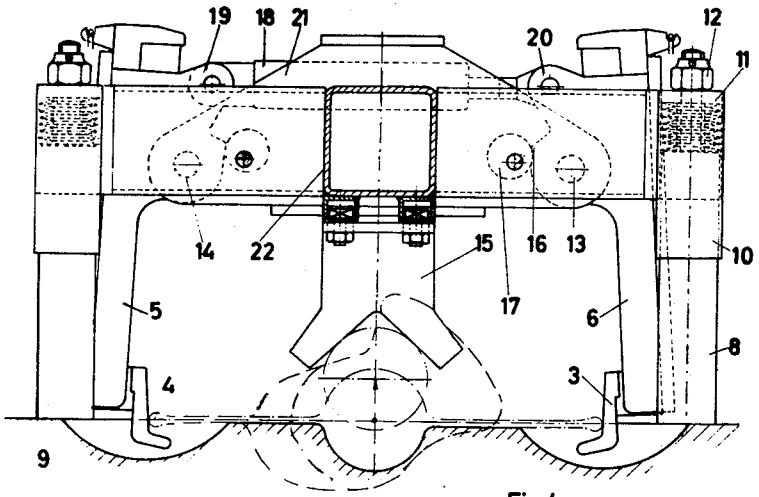

FIGS. 4*a* and 4*b* illustrate a unit that supports two pairs of gripping jaws, one of the coacting pairs being designated 5 and 6, and of the other pair only one gripping jaw 7 being shown. Each gripping jaw supports a gripping claw 3 which coacts with the blank via its recess 2 in the lower part of the forging die.

As described above, each gripping claw 3 is displaceably supported in its gripping jaw. The unit also has two counter-holders 8 and 9 which can coact with the lower part of the forging die. By means of the displaceably arranged gripping claws and the counter-holders, the forging can easily be broken loose from the engraving in the die, as the counter-holders are allowed to coact with the tool at the same time as the gripping claws are displaced. The counter-holders are adjustably supported in special guides 10 by means of spring washers 11 and nuts 12. The counter-holders 8, 9 can be made with contact devices which, when the counter-holders come into contact with the die initiate the movements of the gripping claws. Said contact members are then appropriately allowed to extend into the counter-holders in a way not shown in detail.

The gripping jaws are rotatably supported at their upper parts on shafts 13 and 14, which are parallel to each other. Each unit, at each end, has a securing plate 15. The plates are arranged with recesses directed downwards, by means of which a forging lifted by the gripping claws is secured in its two main directions. In the present case, the forging consists of a crankshaft for a truck or the like.

Each gripping jaw is also made with a stopping lug 16 which, through coaction with an adjustable eccentric disc 17 determines the maximum span of the gripping jaw in question. The gripping movements of each pair of gripping jaws is achieved by means of a hydraulic cylinder 18, which is fastened to the gripping jaws at their upper parts 19 and 20. The hydraulic cylinder can be of a type which is known in itself, with a piston 21 and a chamber. The unit according to FIGS. *4a* and *4b* is fastened to a rotatable tongs arm which is designated 22.

In FIGS. *5a–5c*, the design of the gripping jaws is shown in detail. Each gripping jaw has an inner slide 23, to the lower part of which the gripping claw 3 is fastened by means of a screw 24. The slide is displaceably arranged to the rest of the gripping jaw, and at the top has a head 25 which is provided with an actuating surface 26 for two lifting jacks 27 arranged between the slide and the frame of the gripping jaw, which are of the single-action type. The upper position of the gripping claw 3 is achieved by means of said lifting jacks, while their lower position is achieved with a tension spring 28 set between the slide head 25 and the frame of the gripping jaw.

FIGS. *6a–6c* show a device by means of which the maximum span of the gripping jaws can be set. The eccentric disc 17 is fixed to a shaft 29 by means of a locking pin 30. The turning position of the shaft 29 which is supported in the frame part 31 can be set by means of an arm 32 which, in turn, can be secured with a locking screw 33 to a part of a cam 34. The shafts 29 for the two gripping jaws are connected with each other by means of a transmission (chain) not shown in detail, which is arranged to transmit to jaw 5 the setting of the eccentric disc of the gripping jaw 6 made by means of the arm 32, i.e. the setting of the maximum span for each gripping jaw need only be made at one of the jaws.

FIGS. *7a* and *7b* show robot equipment at a drop hammer 36, a conveyer belt 37, a trimming press 38 and an operating cam 39. Said equipment comprises a column 40, in which a crane arm 41 is fastened. At its outer end, the crane arm is provided with an assembly 42 for turning and horizontally displacing the tongs arm 22, which supports the unit according to FIGS. *4a–4b* and *6a–6c*. In FIG. *7a*, four positions A, B, C and D are shown, the equipment then being shown with solid lines in position A, and with dash lines in positions B and C. Position A is the collecting position of the equipment at the conveyer belt, B is the delivery position and collecting position at the drop hammer, position C is the waiting position at the drop hammer during the forging procedure, and position D is the delivery position at the trimming press. The transfer of the blank from the conveyor belt 37 to the forging press can be effected by the device of the present invention because the blank is preforged and already bears a minor flash thereon. The forged blank is not transferred from the trimming press 38 back to the conveyor belt at any time, and transfer from the trimming press is effected by a separate device (not shown) which does not constitute a portion of the present invention. In FIGS. *7a–7b*, the forging has been given the reference designation 43.

The column 40 supports a hydraulic motor which via a gear arc 45 controls the turning of the crane arm 41 in the horizontal plane according to FIG. *7a*. The column itself comprises an inner upright fastened in the floor 47, and an outer part 48 arranged on the upright via ball bearings, to which outer part the crane arm is fastened by means of welding or the like.

The assembly 42 is shown in more detail in FIGS. *8a–8d*. The assembly has a frame 49, to which the crane arm 41 is fastened, for instance by welding. An inner part 52 is rotatably arranged to the frame on two ball bearings 50 and 51, so that the inner part 52 can be turned in relation to the frame 49 by means of two synchronously operating hydraulic motors 53, which actuate a gear arc 54, fastened to the rotatable inner part, with a gear wheel. Inside the frame and the rotatable inner part a slide 55 is arranged, which is displaceable in its vertical direction by means of a hydraulic cylinder 56. The slide is made in the form of a square tube, which on two opposite sides supports longitudinal guide rules 57, via which four guide wheels 58 coact with the slide 55. At its upper end, the hydraulic cylinder 56 is fastened to a trestle 59 set up on the frame 49 via a supporting pin, and at its lower end the cylinder 56 is connected to the slide 55 via a further supporting pin 60.

The tongs arm 22 is fastened to the lowermost part of the slide 55. The fastening is jointed, so that the tongs arm, from its position at right angles at the center line of the assembly can be pressed upwards so that it can form an acute angle with said center line.

The equipment described above is capable of carrying out two programmes, one programme comprising the movements A → B → A, and the other programme comprising the movements A → B→C → B → D → A.

In the first programme, the preforged blank in the example of the embodiment is fed with the conveyer belt 37 and is made to stop exactly under the gripping member. The smith in the operating cab 39 pushes a button "Start" which causes the following movements to take place: Down → Grip → Centering (pulling loose) → Lifting → Crane arm in → Tongs arm out (to 85°) → Tongs arm out 90° (when the crane arm is in the position over the die) → Lower → Deposit in die (pulling loose returns) → Open → Lift → Tongs arm to 85° → Crane arm out → Tongs arm to home position.

With the other programme, the following procedure takes place when the button "Start" is pushed: Down → Grip → Centering → Lift → Crane arm in → Tongs arm out to 85° → Tongs arm out to 90° → Lower → Deposit in die → Open → Up → Tongs arm to 85° → Crane arm out to position C (wait during the forging operation) → Crane arm in → Tongs arm to 90° → Down → Grip → Pulling loose → Lift → Tongs arm to 85° → Crane arm out → Tongs arm to trimming press (180° turn in relation to the crane arm) → Crane arm to trimming press → Open → Up → Tongs arm to home position → Crane arm to home position.

It is the intention that, in principle, the equipment can be controlled with the aid of 4-way hydraulic valves, cam-actuated flow-check valves, limit switches and fixed stops. The 4-way valves then have double solenoids, and also serve as a relay function when switched on. The members for carrying out the control have been described in the foregoing, the lifting movement thus being carried out with the balanced hydraulic cylinder 56. The turning movements of the crane and tongs arm are carried out by means of the hydraulic motors shown, and the gripping and pulling loose movements of the tongs with the hydraulic cylinders 18 and 27. The same function provides for the pulling loose and centering, which also applies to the depositing in the die if the movement is reversed. The limit switches are actuated by the cam, and are placed in such a way that the machine itself gives the impulses. The equipment is also made so that it is possible to influence e.g. the control of the hydraulic motors 53 with a manual control lever, with which said motors can be given small reciprocating movements in order to obtain fine adjusting movements of the blank in the die in accordance with the positions indicated by dash lines in FIG. 7*a*. Likewise, it is quite simple, with manual control of the hydraulic motor of the column 40 to obtain small reciprocating movements of the blank in its other main direction.

The equipment can also be controlled manually, and switching from manual to either of the above-mentioned two programmes can easily be done by means of knobs or the like from the control panel, which is placed in the operating cab together with the control apparatus for the drop hammer.

The control of the equipment is not included in the actual invention, and will therefore not be taken up in detail here.

Figure 9:
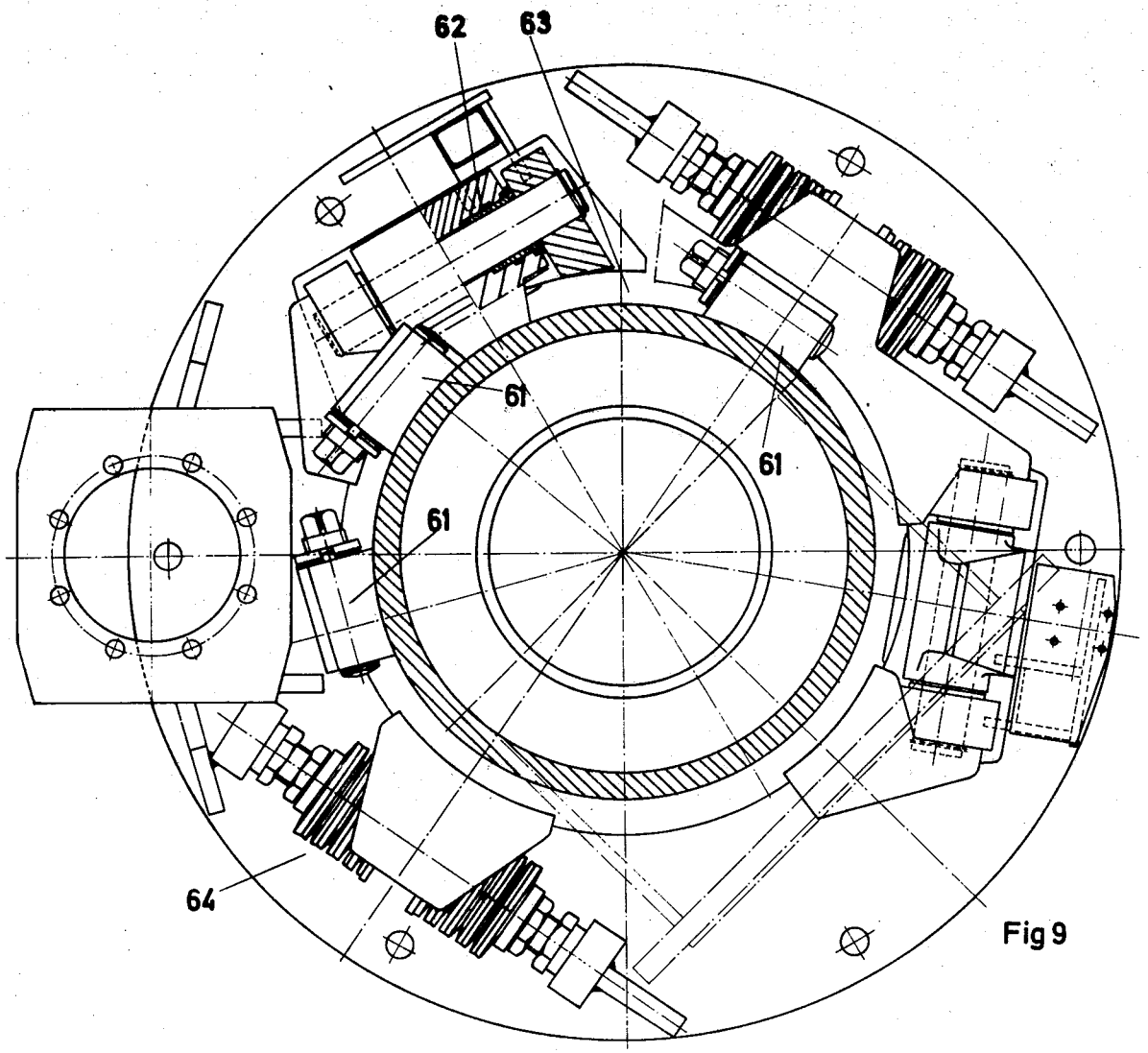

In order that exact positions will be obtained, a number of stopping lugs are arranged on the column and the crane arm, and the stopping lugs of the column are shown in FIG. 9, and are designated 61. Fine adjustments of the stopping lugs can be made by means of screw threads. The stop for the stopping lugs consists of a fixed lug 62 fastened to a ring 63 which is placed around the rotatable column, but is not fastened together with this. The ring 63 is attached to the base by means of two stiff spring packs 64, calculated for individual maximum strokes, but with insignificant spring action at normal operation.

The stop 62 fastened to the ring is fixed to the ring, but is arranged in such a way that, through hinges, it can be moved away automatically by a hydraulic cylinder when one of the stopping positions is not to function.

In order to obtain rapid function during automatic operation, it is essential that, for instance, the hydraulic cylinder 56 can work rapidly. FIG. 10 shows an example of a hydraulic cylinder which is suitable for this purpose, which has two chambers and two pistons, and an accumulator 65 connected to one of the chambers. The hydraulic cylinder operates with a fine check valve 66 for one of the chambers, and a constant constriction 67 for the other chamber.

Figure 11:
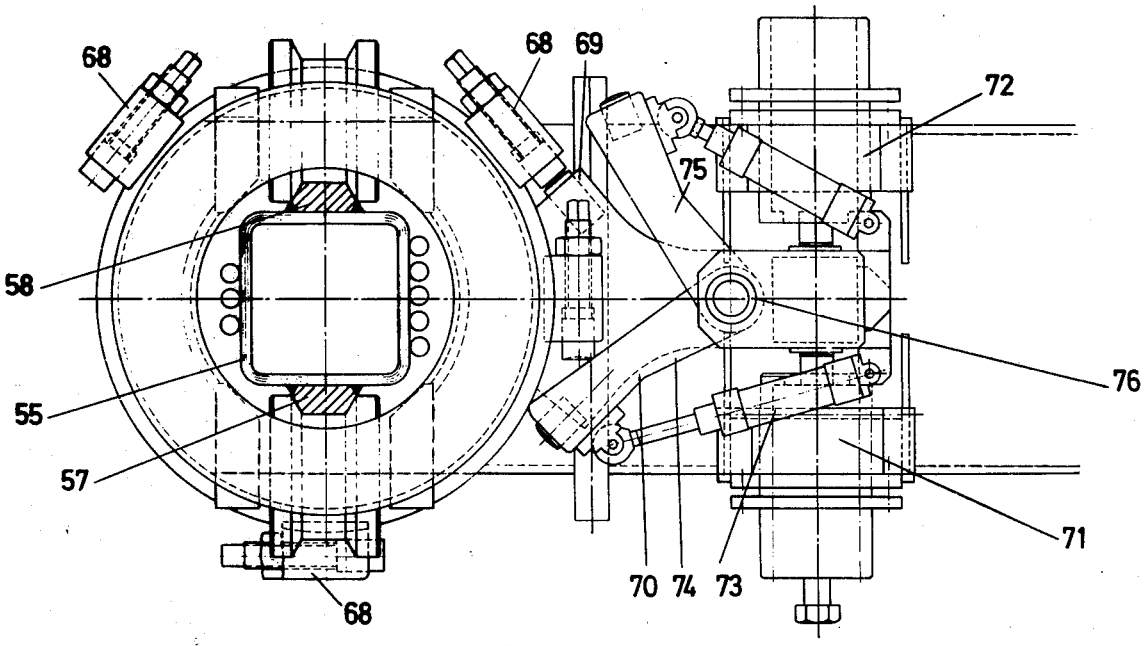

FIG. 11 shows examples of horizontally arranged stopping lugs on the assembly 42. In this case, said lugs are designated 68, while the fixed stops that coact with said lugs are designated 69 and 70. The spring packs corresponding to the above-mentioned spring packs 64 are in this case designated 71 and 72 (see also FIG. 8*c*). This embodiment also shows stopping arms 74 and 75 (see also FIG. 8*c*) which can be controlled by means of hydraulic pistons 73, which arms are supported in a vertical shaft 76. Said stopping lugs and fixed stops are arranged to prevent turning more than 180° between parts 49 and 52.

The invention is not limited to the embodiment shown above as an example, but can be subject to modifications within the scope of the following claims.

I claim:

1. A device adapted to coact with the flash on a hot blank for manipulating said blank relative to a forging tool in a drop hammer, said forging tool comprising a lower die member, said device comprising two pairs of gripping jaws carried by a unit connected to a rotatable tongs arm, said jaws being operative to coact with said blank via recesses provided in said forging tool, each of said recesses having a smoothly curved, cup-shaped interior configuration dimensioned to receive one of said gripping jaws during movement of said tongs arm, each of said recesses being located in said forging tool at a position spaced inwardly from the outer edges of said tool at a location below at least a portion of the flash formed on said blank when said blank is forged in said forging tool, a counter-holder positioned to engage said lower die member of said forging tool adjacent an edge of each of said recesses, said gripping jaws and said counter-holder being mounted on said unit for insertion over said blank by movement of said tongs arm, a gripping claw supported by each of said gripping jaws respectively for selectively engaging said flash, each of said gripping claws being spaced from and vertically displaceable relative to said counter-holder, means for moving said tongs arm to insert said claws into said cup-shaped recesses in said tool while positioning said counter-holder over said forging tool adjacent said edges of said recesses, and means for effecting a selective vertical displacement of said gripping claws in relation to said counter-holder to effect simultaneous coaction between said gripping claws and the flash on said blank and between said counter-holder and said lower die member thereby to break loose a forged blank from said tool, each of said gripping jaws including an elongated slidable member which supports one of said gripping claws at its lower end, said slidable member being displaceable in its longitudinal direction relative to said gripping jaw, at least one single-action lifting jack and at least one spring connected to said slidable member for selectively displacing said slidable member relative to said jaw, the gripping jaws in the respective pairs of gripping jaws being pivotably supported on two parallel shafts, and a hydraulic piston connected to the upper parts of said jaws for controlling movement of said jaws about said shafts to move said claws toward and away from one another.

2. The device of claim 1 including means for defining the maximum opening between said gripping jaws.

3. The device of claim 2 wherein said tongs arm comprises a portion of robot equipment operative to effect automatic control of the gripping jaws and their gripping claws, said equipment including an assembly for turning and for effecting lateral displacement of said tongs arm, said assembly being fastened to a crane arm which is rotatably fastened in a column.

4. The device of claim 3 wherein said assembly comprises a frame fastened to said crane arm, a rotatable inner part fastened to said frame, at least one hydraulic motor connected to said inner part for selectively rotating said inner part, and a slide displaceable in said inner part by means of a hydraulic cylinder, said tongs arm being fastened to said slide.

5. The device of claim 4 wherein said slide comprises a square tube which supports longitudinal guide rules on two opposite sides thereof, said guide rules coacting with guide wheels in said frame.

6. The device of claim 4 wherein said hydraulic cylinder comprises two chambers, two pistons, and an accumulator for one of said chambers.

7. The device of claim 3 wherein said column is disposed adjacent the drop hammer, said robot equipment being programmed to transfer the blank from a conveyor belt to the drop hammer.

8. The device of claim 7 wherein said equipment is also arranged to transfer the forging from the drop hammer to a trimming press positioned adjacent the drop hammer and the conveyor belt.

9. A device adapted to coact with the flash on a hot blank for manipulating said blank relative to a forging tool in a drop hammer, said forging tool comprising a lower die member, said device comprising at least one gripping jaw carried by a unit connected to a rotatable tongs arm, said jaw being operative to coact with said blank via a recess provided in said forging tool, said recess having a smoothly curved, cup-shaped interior configuration dimensioned to receive said gripping jaw during movement of said tongs arm, said recess being located in said forging tool at a position spaced inwardly from the outer edges of said tool at a location below at least a portion of the flash formed on said blank when said blank is forged in said forging tool, a counter-holder positioned to engage said lower die member of said forging tool adjacent an edge of said recess, said gripping jaw and said counter-holder both being mounted on said unit for insertion over said blank by movement of said tongs arm, a gripping claw supported by said gripping jaw for selectively engaging said flash, said gripping claw being spaced from and vertically displaceable relative to said counter-holder, means for moving said tongs arm to insert said claw into said cup-shaped recess in said tool while positioning said counter-holder over said forging tool adjacent said edge of said recess, means for effecting a selective vertical displacement of said gripping claw in relation to said counter-holder to effect simultaneous coaction between said gripping claw and the flash on said blank and between said counter-holder and said lower die member of said forging tool thereby to break loose a forged blank from said tool, and a directing plate on the under side of said unit cooperating with said gripping claw to secure the blank in position relative to said unit.

* * * * *